US011608686B2

(12) United States Patent
Alkhowaildi et al.

(10) Patent No.: US 11,608,686 B2
(45) Date of Patent: Mar. 21, 2023

(54) WHIPSTOCK ASSEMBLIES AND METHODS FOR USING THE SAME

(71) Applicant: Saudi Arabian Oil Company, Dhahran (SA)

(72) Inventors: Mohammed Ahmed Alkhowaildi, Safwa (SA); Ahmed Abdulaziz Al-Mousa, Doha (SA)

(73) Assignee: Saudi Arabian Oil Company, Dhahran (SA)

( * ) Notice: Subject to any disclaimer, the term of this patent is extended or adjusted under 35 U.S.C. 154(b) by 154 days.

(21) Appl. No.: 17/174,487

(22) Filed: Feb. 12, 2021

(65) Prior Publication Data

US 2022/0259924 A1 Aug. 18, 2022

(51) Int. Cl.

| | |
|---|---|
| ***E21B 7/06*** | (2006.01) |
| ***E21B 23/06*** | (2006.01) |
| ***E21B 33/12*** | (2006.01) |

(52) U.S. Cl.

CPC ..... *E21B 7/061* (2013.01); *E21B 23/06* (2013.01); *E21B 33/12* (2013.01)

(58) Field of Classification Search

CPC ..... E21B 7/061; E21B 23/06; E21B 33/12
See application file for complete search history.

(56) References Cited

U.S. PATENT DOCUMENTS

| | | | | |
|---|---|---|---|---|
| 3,336,990 A | | 8/1967 | Warner et al. | |
| 4,397,355 A | | 8/1983 | McLamore | |
| 4,415,205 A | * | 11/1983 | Rehm | E21B 41/0035 299/5 |
| 4,554,982 A | * | 11/1985 | Burton | E21B 4/02 175/325.2 |
| 4,765,404 A | | 8/1988 | Bailey et al. | |
| 5,113,938 A | * | 5/1992 | Clayton | E21B 7/061 166/134 |
| 5,193,620 A | | 3/1993 | Braddick | |
| 5,335,737 A | | 8/1994 | Baugh | |
| 5,398,754 A | | 3/1995 | Dinhoble | |
| 5,409,060 A | * | 4/1995 | Carter | E21B 10/60 166/241.1 |
| 5,425,417 A | * | 6/1995 | Carter | E21B 10/50 166/117.6 |
| 5,435,400 A | * | 7/1995 | Smith | E21B 43/305 166/117.6 |
| 5,531,271 A | * | 7/1996 | Carter | E21B 23/02 166/117.6 |
| 5,871,046 A | * | 2/1999 | Robison | E21B 7/061 166/241.1 |
| 6,360,821 B1 | * | 3/2002 | Braddick | E21B 7/061 166/216 |

(Continued)

*Primary Examiner* — Steven A MacDonald
(74) *Attorney, Agent, or Firm* — Dinsmore & Shohl LLP

(57) ABSTRACT

A whipstock assembly including a main body defining an axial direction extending through the main body, a circumferential direction, and a radial direction transverse to the axial direction, and a ramp body pivotally coupled to the main body, the ramp body defining a ramp surface that is oriented transverse to the radial direction, and where the ramp body is movable between a retracted position and an extended position, where the ramp surface is further from the main body in the axial direction in the extended position as compared to the retracted position and the ramp body is rotatable with respect to the main body about the circumferential direction.

20 Claims, 7 Drawing Sheets

(56) References Cited

U.S. PATENT DOCUMENTS

| | | | | |
|---|---|---|---|---|
| 6,464,002 | B1 * | 10/2002 | Hart | E21B 29/06 175/81 |
| 6,719,045 | B2 * | 4/2004 | Hart | E21B 29/06 166/242.6 |
| 10,724,302 | B2 * | 7/2020 | McCormack | E21B 29/06 |
| 11,391,094 | B2 * | 7/2022 | McCormack | E21B 29/06 |
| 2002/0023781 | A1 | 2/2002 | Peters | |
| 2002/0070018 | A1 * | 6/2002 | Buyaert | E21B 23/006 166/117.6 |
| 2002/0195243 | A1 * | 12/2002 | Hart | E21B 29/06 166/117.6 |
| 2014/0216760 | A1 * | 8/2014 | Dancer | E21B 7/061 166/243 |
| 2017/0044843 | A1 | 2/2017 | Hanton et al. | |
| 2017/0204667 | A1 * | 7/2017 | Mccormack | E21B 7/061 |
| 2020/0318434 | A1 * | 10/2020 | Mccormack | E21B 29/06 |

* cited by examiner

WHIPSTOCK ASSEMBLIES AND METHODS FOR USING THE SAME

BACKGROUND

Field

The present disclosure relates to whipstock assemblies for directing a drill string and methods for using the same.

Technical Background

Oil and/or gas may be extracted from subterranean reservoirs through wellbores drilled into the ground. The wellbores generally extend below a surface of the ground to oil and/or gas reservoirs positioned below the surface.

BRIEF SUMMARY

In some instances, it is desirable to form wellbores extending in a horizontal direction below the surface of the ground. For example, it may be difficult to drill a wellbore directly above an oil and/or gas reservoir, and accordingly, it may be necessary for at least a portion of the wellbore to extend in the horizontal direction to access the oil and/or gas reservoir. Additionally, in some circumstances, one or more side wellbores may be formed in communication with a main wellbore, sometimes referred to as a "mother wellbore" or "motherbore." The one or more side wellbores and the motherbore may extend within a reservoir, and the one or more side wellbores may increase the flow of oil and/or gas through the motherbore to the surface.

Embodiments of the present disclosure are generally directed to whipstock assemblies that direct a string, such as a drill string, in a direction transverse to a main wellbore. The whipstock assemblies may generally be positioned within the main wellbore, and may be secured to the main wellbore through a packer assembly or the like. Whipstock assemblies according to the present disclosure generally include a ramp body having an inclined surface that directs the string in a direction transverse to the main wellbore. By directing the string in a direction transverse to the main wellbore, side wellbores in communication with the main wellbore can be formed with the string. Further, in embodiments in which the main wellbore has a vertical orientation, by directing the string in a direction transverse to the main wellbore, one or more horizontal side wellbores may be formed in communication with the main wellbore.

To form multiple side wellbores, the whipstock assembly may be moved along the main wellbore to form side wellbores at different positions along the main wellbore and/or may be rotated within the main wellbore to form side wellbores at different azimuths with respect to the main wellbore. However, releasing the packer assembly to move the whipstock assembly along the main wellbore and/or to rotate the whipstock assembly within the main wellbore may be time consuming and costly.

Embodiments according to the present disclosure are generally directed to whipstock assemblies including a ramp body that is movable with respect to a main body. For example, in some embodiments, a packer assembly is engaged with the main body, such that the main body is generally stationary with respect to the packer assembly and the wellbore. The ramp body, in embodiments, is rotatable and/or movable in an axial direction with respect to the main body of the whipstock assembly. By moving the ramp body with respect to the main body of the whipstock assembly (e.g., via rotation and/or movement in the axial direction), multiple side wellbores may be formed without disengaging the packer assembly, thereby reducing the time and cost associated with forming the side wellbores.

In one embodiment, a whipstock assembly including a main body defining an axial direction extending through the main body, a circumferential direction, and a radial direction transverse to the axial direction, and a ramp body pivotally coupled to the main body, the ramp body defining a ramp surface that is oriented transverse to the radial direction, and where the ramp body is movable between a retracted position and an extended position, where the ramp surface is further from the main body in the axial direction in the extended position as compared to the retracted position and the ramp body is rotatable with respect to the main body about the circumferential direction.

In another embodiment, a method for drilling a wellbore includes engaging a string engagement feature of a whipstock assembly with a string, rotating a ramp body of the whipstock assembly with the string in a circumferential direction with respect to a main body of the whipstock assembly, where the ramp body is pivotally coupled to the main body of the whipstock assembly, and moving the ramp body from a retracted position to an extended position, where a ramp surface of the ramp body is further from the main body in an axial direction in the extended position as compared to the retracted position.

In yet another embodiment, a whipstock assembly including a main body defining an axial direction extending through the main body and a circumferential direction, a ramp body pivotally coupled to the main body, the ramp body defining a ramp surface that is oriented transverse to the axial direction, a locking assembly, the locking assembly positionable between a locked position, in which the locking assembly restricts movement of the ramp body with respect to the main body in the axial direction, and an unlocked position, in which the ramp body is movable with respect to the main body in the axial direction, and a pivot assembly positioned between the ramp body and the main body, where the ramp body is rotatable with respect to the main body about the pivot assembly in the circumferential direction.

Additional features and advantages of the technology disclosed in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments according to the present disclosure are generally directed to whipstock assemblies including a ramp body that is movable with respect to a main body. For example, in some embodiments, a packer assembly is engaged with the main body, such that the main body is generally stationary with respect to the packer assembly and the wellbore. The ramp body, in embodiments, is rotatable and/or movable in an axial direction with respect to the main body of the whipstock assembly. By moving the ramp body with respect to the main body of the whipstock assembly (e.g., via rotation and/or movement in the axial direction), multiple side wellbores may be formed without disengaging the packer assembly, thereby reducing the time and cost associated with forming the side wellbores. These and other embodiments will now be described with reference to the appended drawings.

As referred to herein, the term "axial direction" refers to a direction extending through whipstock assemblies described herein (i.e., in the A-direction as depicted in the figures). The term "circumferential direction" refers to a direction extending around the whipstock assemblies described herein (i.e., in the C-direction as depicted in the figures). The term "radial direction" refers to a direction extending outward from the whipstock assemblies described herein, and is transverse to the axial direction A (i.e., in the R-direction as depicted in the figures).

Figure 1:
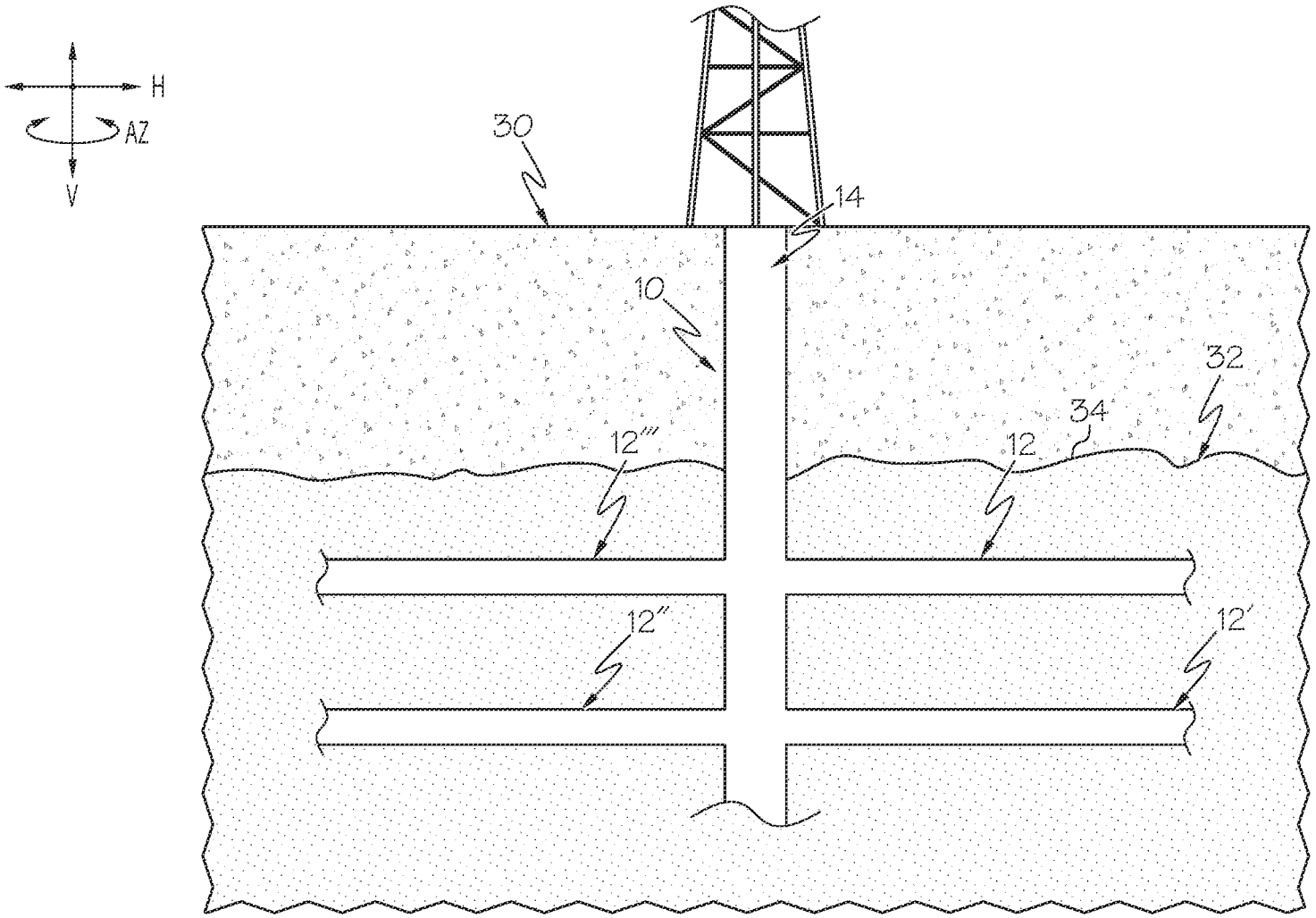
FIG. 1 schematically depicts a section view of a main wellbore and side wellbores in communication with the main wellbore, according to one or more embodiments shown and described herein.

Now referring to FIG. 1, a section view of a main wellbore 10 and four side wellbores 12 is schematically depicted. The main wellbore 10 generally extends from an opening 14 below a surface 30, which may be a ground surface (i.e., in land-based wellbores 10) or may be the floor of a body of water (i.e., in offshore wellbores 10). Gases and/or fluids, such as petroleum products, may be extracted through the wellbore 10, and flow to the surface 30 through the opening 14.

For example, petroleum may be positioned in subterranean geologic formations, which are sometimes referred to as "reservoirs." In the view shown in FIG. 1, the main wellbore 10 extends through a reservoir boundary 34 of a reservoir 32. While in the view shown in FIG. 1, the reservoir boundary 34 is depicted as extending in a generally horizontal direction where the main wellbore 10 intersects the reservoir boundary 34, it should be understood that this is merely an example. In some reservoirs 32, the reservoir boundary 34 may extend in any direction and may extend in multiple directions along a perimeter of the reservoir 32.

Gases and/or fluids from the reservoir 32 may generally flow to the main wellbore 10 and may flow through the main wellbore 10 to the surface 30. To increase the amount of gases and/or fluids flowing from the reservoir 32, the side wellbores 12 may be formed extending outward from the main wellbore 10. For example, in the embodiment depicted in FIG. 1, a first side wellbore 12, a second side wellbore 12', a third side wellbore 12", and a fourth side wellbore 12''' extend outward from and are in communication with the main wellbore 10. In embodiments, the side wellbores 12, 12', 12", 12''' are located at different positions along the main wellbore 10. For example, in the embodiment depicted in FIG. 1, the main wellbore 10 has a generally vertical orientation, and the side wellbores 12, 12', 12", 12''' are located at different vertical positions along the main wellbore 10 (i.e., at different positions in the V-direction as depicted). In the example shown in FIG. 1, the first and the fourth side wellbores 12, 12''' are positioned above the second and third side wellbores 12', 12" in the vertical direction (i.e., in the V-direction as depicted). While in the example shown in FIG. 1 the main wellbore 10 generally extends in the vertical direction and the side wellbores 12, 12', 12", 12''' are positioned at different heights (i.e., in the V-direction as depicted), it should be understood that this is merely an example. In some configurations, portions of the main wellbore 10 may extend at least partially in a horizontal direction (i.e., in the H-direction as depicted) that is transverse to the vertical direction, and portions of the side wellbores 12, 12', 12", 12''' may extend at least partially in the vertical direction.

In some embodiments, the side wellbores 12, 12', 12", 12''' also extend outward from the main wellbore 10 at different azimuths with respect to the main wellbore 10 (i.e., at different directions in the AZ-direction as depicted). While in the view depicted in FIG. 1 the first and second side wellbores 12, 12' are shown as extending outward from the main wellbore 10 at the same azimuth, and the third and fourth side wellbores 12", 12''' are shown as extending outward from the main wellbore 10 at the same azimuth, it should be understood that this is merely an example. In embodiments, the side wellbores 12, 12', 12", 12''' may extend outward from the main wellbore 10 at any suitable azimuth. Further, while four side wellbores 12, 12', 12", 12''' are depicted in the example shown in FIG. 1, it should be understood that this is merely an example, and any suitable number of side wellbores 12 may be formed extending outward from the main wellbore 10.

Oil and/or gas may pass from the reservoir 32, through sidewalls of the main wellbore 10, and through the main wellbore 10 to the surface 30 for extraction. Oil and/or gas may also pass from the reservoir 32, through sidewalls of the side wellbores 12, 12', 12", 12''', through the side wellbores 12, 12', 12", 12''' to the main wellbore 10, and through the main wellbore 10 to the surface 30 for extraction. Without being bound by theory, the side wellbores 12, 12', 12", 12''' may increase the amount of oil and/or gas that can be extracted through the main wellbore 10. For example, the sidewalls of the side wellbores 12, 12', 12", 12'" generally increase the effective surface area of sidewalls extending within the reservoir 32 available for oil and/or gas to pass to the main wellbore 10, as compared to wellbores that do not include side wellbores. Put another way, the side wellbores 12, 12', 12", 12'" provide additional pathways for oil and/or gas to reach the main wellbore 10 and subsequently the surface 30, which may thereby increase the flow of oil and/or gas through the main wellbore 10 for extraction. In this way, the side wellbores 12, 12', 12", 12' may generally increase the productivity of the wellbore 10.

In embodiments, the side wellbores 12, 12', 12", 12'" may be formed by directing a drill string in directions transverse to the main wellbore 10, for example via a whipstock assembly.

Figure 2A:
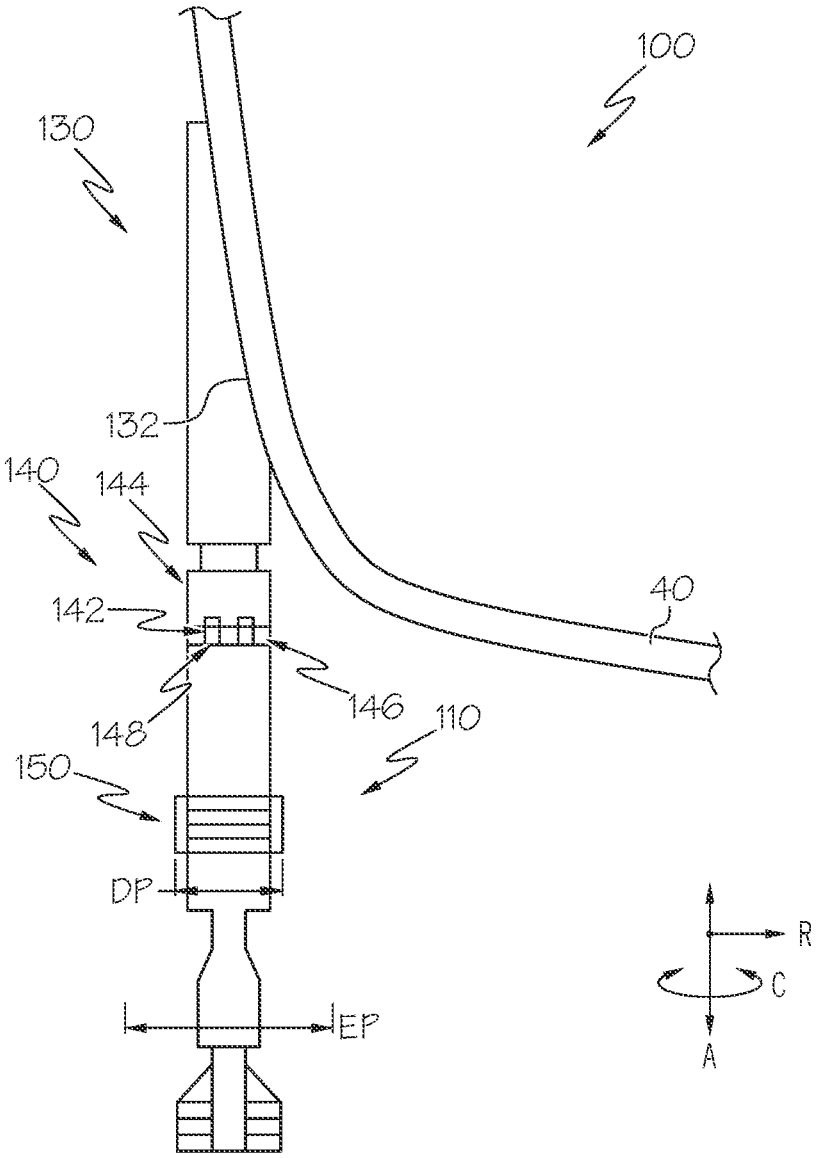
FIG. 2A schematically depicts a side view of a string and a whipstock assembly including a main body, a ramp body, and a packer assembly, according to one or more embodiments shown and described herein.

Referring to FIG. 2A, a side view of an example whipstock assembly 100 is schematically depicted. In embodiments, the whipstock assembly 100 includes a main body 110 and a ramp body 130 coupled to the main body 110. In some embodiments, the ramp body 130 is pivotally coupled to the main body 110, such that the ramp body 130 is rotatable with respect to the ramp body 130 in the circumferential direction C.

For example, in some embodiments, the whipstock assembly 100 includes a pivot assembly 140. The pivot assembly 140, in embodiments, is positioned between the ramp body 130 and the main body 110 in the axial direction, and the ramp body 130 is rotatable with respect to the main body 110 about the pivot assembly 140, for example, in the circumferential direction C. In some embodiments, the pivot assembly 140 includes one or more bearings or the like that allows the ramp body 130 to rotate with respect to the main body 110 in the circumferential direction C.

In some embodiments, the pivot assembly 140 includes a main body portion 142 coupled to the main body 110. The main body portion 142 may be coupled to the main body 110 such that rotation of the main body portion 142 with respect to the main body 110 about the circumferential direction C is restricted. The main body portion 142 of the pivot assembly 140, in some embodiments, includes one or more main body teeth 148.

In some embodiments, the pivot assembly 140 further includes a ramp body portion 144 coupled to the ramp body 130. The ramp body portion 144 is coupled to the ramp body 130 such that rotation of the ramp body portion 144 with respect to the ramp body 130 in the circumferential direction C is restricted. The ramp body portion 144 of the pivot assembly 140, in some embodiments, includes one or more ramp body teeth 146 engaged with the one or more main body teeth 148 of the main body portion 142. Engagement between the one or more ramp body teeth 146 and the one or more main body teeth 148, in embodiments, restricts rotation of the ramp body portion 144 with respect to the main body portion 142 in the circumferential direction C. Restriction of rotation of the ramp body portion 144 with respect to the main body portion 142 in the circumferential direction C restricts rotation of the ramp body 130 with respect to the main body 110 in the circumferential direction C.

Figure 2C:
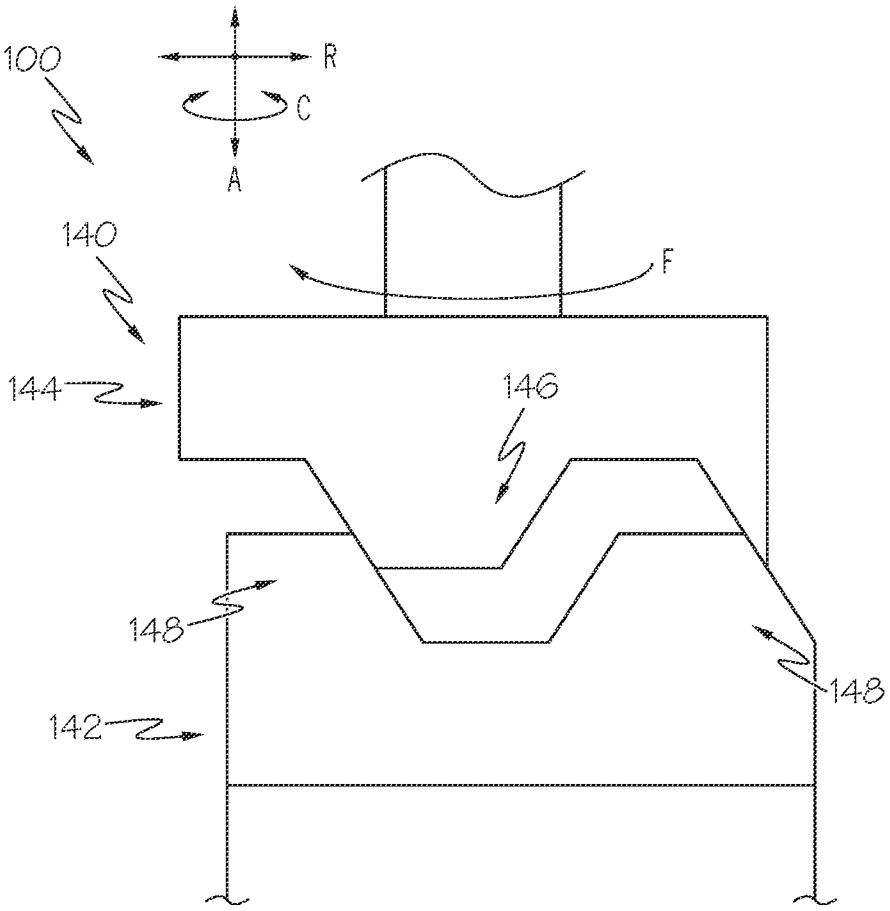
FIG. 2C schematically depicts an enlarged side view of the pivot assembly of FIG. 2B rotating, according to one or more embodiments shown and described herein.
Figure 2B:
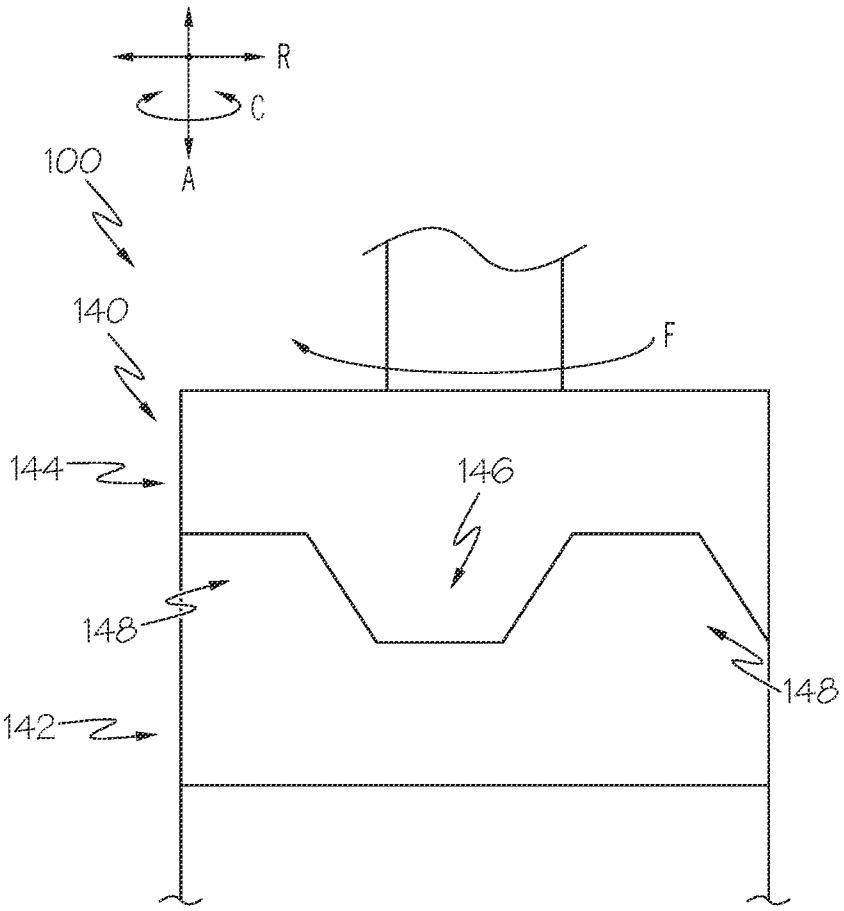
FIG. 2B schematically depicts an enlarged side view of a pivot assembly of the whipstock assembly of FIG. 2A, according to one or more embodiments shown and described herein.

Referring to FIGS. 2A-2C, in some embodiments, tooth faces of the one or more ramp body teeth 146 and/or tooth faces of the one or more main body teeth 148 are oriented transverse to the axial direction A. In these embodiments, force applied to the ramp body portion 144 in the circumferential direction C resolves at least partially into a force in the axial direction A. For example and as shown in FIGS. 2B and 2C, as a force is applied to the ramp body portion 144 in the circumferential direction C, engagement between the one or more ramp body teeth 146 and the one or more main body teeth 148 may cause the ramp body portion 144 to move away from the main body portion 142 in the axial direction A. As the ramp body portion 144 moves away from the main body portion 142 in the axial direction A, the ramp body portion 144 may be permitted to rotate in the circumferential direction C with respect to the main body portion 142. As the ramp body portion 144 continues to rotate, the one or more ramp body teeth 146 move into engagement with adjacent main body teeth 148, again restricting rotation of the ramp body portion 144 with respect to the main body portion 142. In this way, the pivot assembly 140 may selectively restrict rotation of the ramp body portion 144 with respect to the main body portion 142, and accordingly restrict rotation of the ramp body 130 with respect to the main body 110 in the circumferential direction C.

Referring again to FIG. 2A, in embodiments, the ramp body 130 defines a ramp surface 132 that is oriented transverse to the radial direction R. For example, in the embodiment depicted in FIG. 2A, the ramp surface 132 faces at least partially in the axial direction A. Because the ramp surface 132 faces at least partially in the axial direction A, the ramp surface 132 may direct a drill string 40 engaging the ramp surface 132 in the axial direction A to extend in the radial direction R. By directing the drill string 40 in the radial direction R, the ramp surface 132 of the ramp body 130 may assist in directing the drill string 40 to drill one or more of the side wellbores 12, 12', 12", 12' (FIG. 1), as described in greater detail herein. The drill string 40 may include a bottom hole assembly (BHA) or the like that is suitable to form the one or more side wellbores 12, 12', 12", 12'" (FIG. 1). In some embodiments, the drill string 40 may include imaging equipment, such as a three-dimensional X-ray unit or the like suitable to monitor conditions within the one or more side wellbores 12, 12', 12", 12'" (FIG. 1).

Figure 2D:
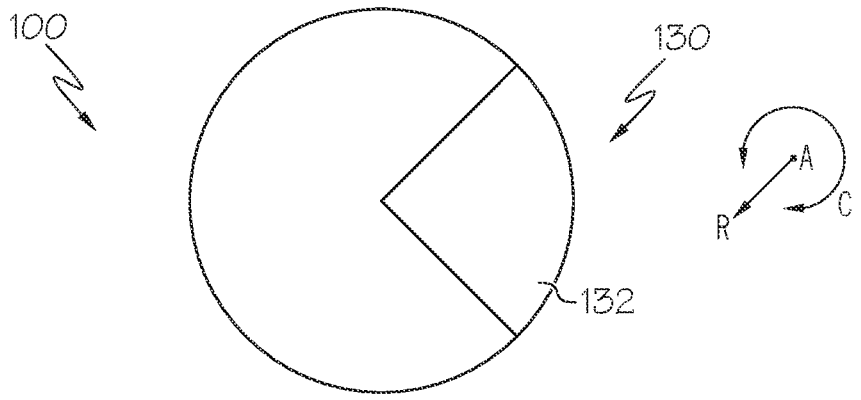
FIG. 2D schematically depicts a top view of the whipstock assembly of FIG. 2A, according to one or more embodiments shown and described herein.

Referring collectively to FIGS. 2A and 2D, a top view of the whipstock assembly 100 is depicted. In embodiments, the ramp body 130 may define a generally conical or frustroconical shape, and the ramp surface 132 is defined on an outer surface of the ramp body 130. In embodiments, the ramp surface 132 may be a planar surface, a curved surface, or the like that is suitable to direct the drill string 40 in the radial direction R.

Figure 2E:
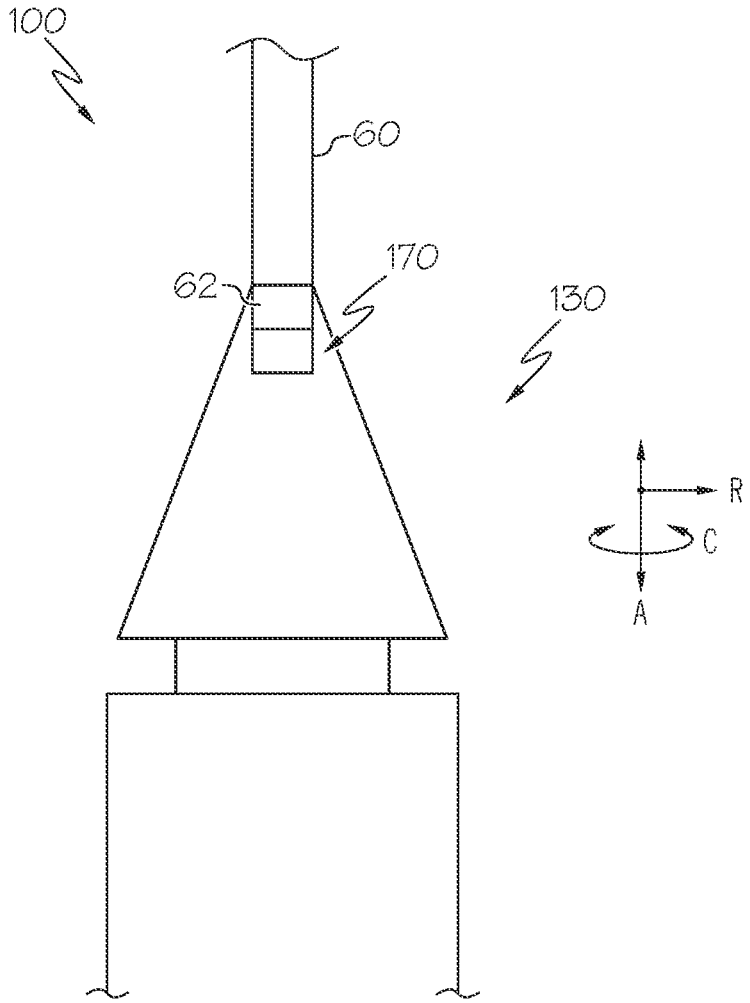
FIG. 2E schematically depicts an enlarged side view of the ramp body of the whipstock assembly of FIG. 2A, according to one or more embodiments shown and described herein.

Referring to FIGS. 2A and 2E, an enlarged side view of the ramp body 130 is depicted. In some embodiments, the whipstock assembly 100 includes a string engagement feature 170. The string engagement feature 170, in embodiments, is structurally configured to engage a string 60. For example, the string engagement feature 170 may include an aperture or the like that is engageable with a corresponding retrieval tool 62 attached to the string 60. In embodiments, the retrieval tool 62 attached to the string 60 may engage the string engagement feature 170 to move the ramp body 130 in the axial direction A, and/or the circumferential direction C, as described in greater detail herein.

Referring to FIG. 2A, in some embodiments, the whipstock assembly 100 includes a packer assembly 150. The packer assembly 150, in some embodiments, is engaged with and extends outward from the main body 110. In embodiments, the packer assembly 150 is positionable between an engaged position, in which the packer assembly 150 defines an engaged packer perimeter EP, and a disengaged position, in which the packer assembly 150 defines a disengaged packer perimeter DP that is less than the engaged packer perimeter EP. By moving the packer assembly 150 between the engaged position and the disengaged position, the packer assembly 150 may be selectively engaged with sidewalls of the main wellbore 10 (FIG. 1). Through engagement with the sidewalls of the main wellbore 10 (FIG. 1) and engagement with the main body 110, the packer assembly 150 may restrict movement of the main body 110 with respect to the main wellbore 10.

In embodiments, the ramp body 130 is movable between a retracted position and an extended position, where the ramp surface 132 is further from the main body 110 in the axial direction A in the extended position as compared to the retracted position. For example and referring to FIGS. 3 and 4, a side view of the whipstock assembly 100 is shown in the retracted position (FIG. 3) and the extended position (FIG. 4). In the retracted position shown in FIG. 3, the ramp surface 132 is spaced apart from a bottom end of the main body 110 by a distance d1. In the extended position show in FIG. 4, the ramp surface 132 is spaced apart from the bottom end of the main body 110 by a distance d2, where the distance d2 is greater than the distance d1. In the retracted position shown in FIG. 3, the whipstock assembly 100 extends a retracted distance Rd in the axial direction A. In the extended position shown in FIG. 4, the whipstock assembly 100 extends an extended distance Ed in the axial direction A, where the extended distance Ed is greater than the retracted distance Rd. By moving the ramp body 130 from the retracted position (FIG. 3) to the extended position (FIG. 4), the ramp surface 132 may be repositioned with respect to the main body 110 in the axial direction A. By repositioning the ramp surface 132 with respect to the main body 110 in the axial direction A, side wellbores 12, 12', 12", 12''' (FIG. 1) may be formed at different positions along the main wellbore 10 (FIG. 1), as described in greater detail herein.

In some embodiments, the whipstock assembly 100 includes a locking assembly 160. The locking assembly 160 is positionable between a locked position and an unlocked position. In the locked position, the locking assembly 160 restricts movement of the ramp body 130 with respect to the main body 110 in the axial direction A. In the unlocked position, the ramp body 130 is movable with respect to the main body 110 in the axial direction A.

Figure 3:
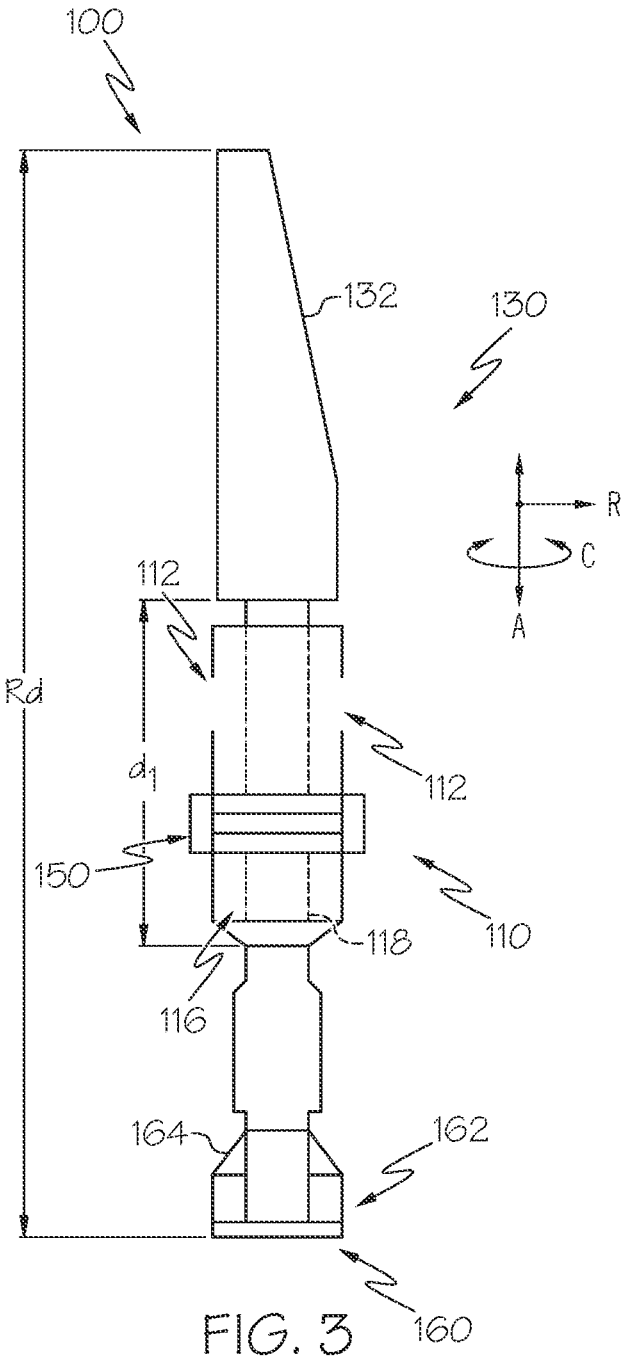
FIG. 3 schematically depicts a side view of the whipstock assembly of FIG. 2A in a retracted position, according to one or more embodiments shown and described herein.
Figure 4:
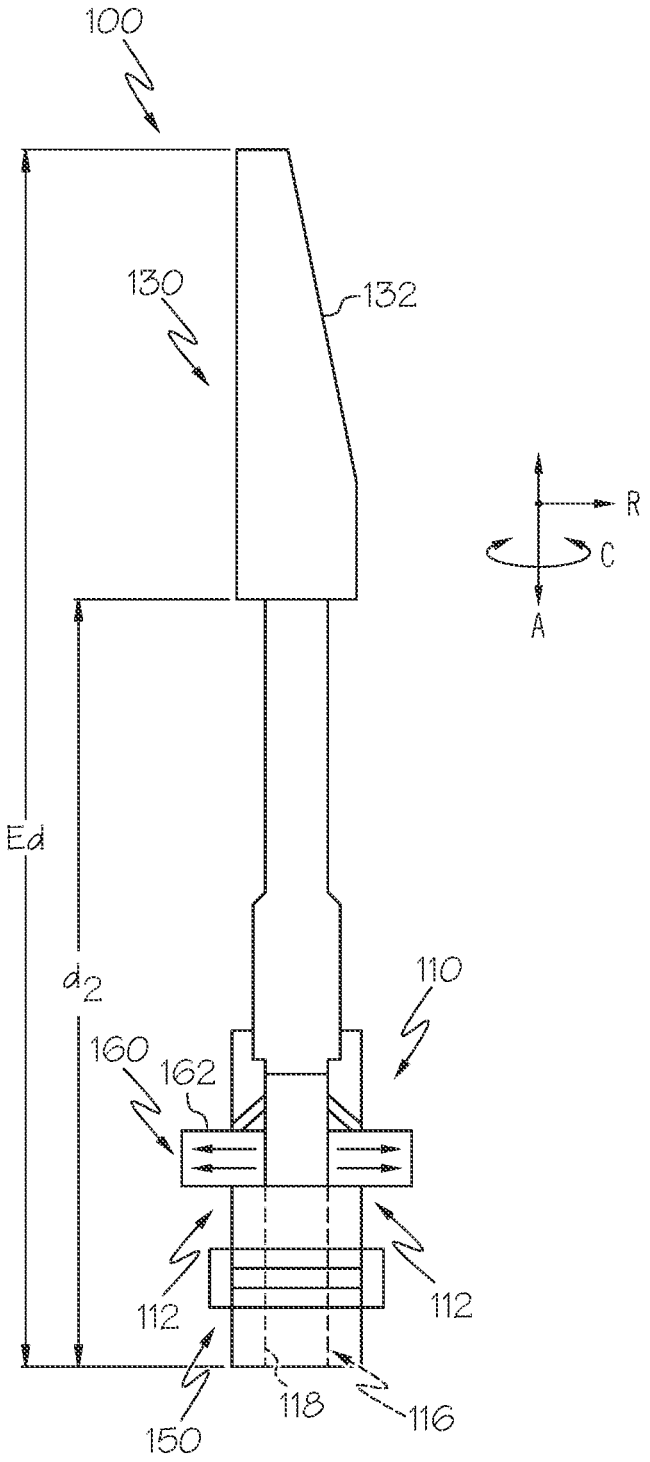
FIG. 4 schematically depicts a side view of the whipstock assembly of FIG. 2A in an extended position, according to one or more embodiments shown and described herein.
Figure 5:
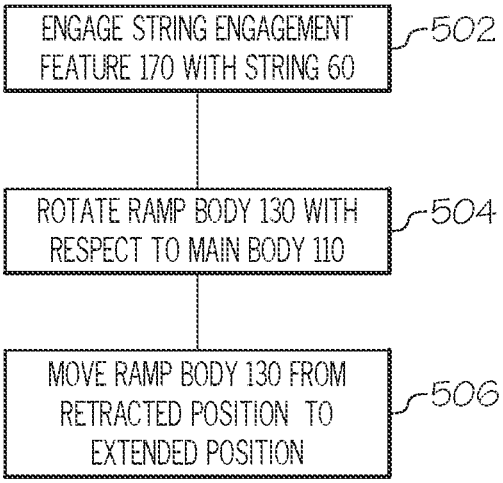
FIG. 5 is a flowchart of an example method of using the whipstock assembly of FIG. 2A, according to one or more embodiments shown and described herein.

For example, in the embodiment depicted in FIGS. 3 and 4, the locking assembly 160 coupled to or integral with the ramp body 130. In some embodiments, the locking assembly 160 is spaced apart from the ramp surface 132 of the ramp body 130 in the axial direction A. For example, in the embodiment depicted in FIGS. 3 and 4, the locking assembly 160 is positioned opposite ramp surface 132 on the ramp body 130 in the axial direction A.

In the unlocked position shown in FIG. 3, the locking assembly 160 is spaced apart from the main body 110 in the axial direction A. However, it should be understood that this is merely an example. In some embodiments the locking assembly 160 may be engaged with or at least partially engaged with the main body 110 in the unlocked position such that the ramp body 130 is movable with respect to the main body 110 in the unlocked position.

In the embodiment depicted in FIGS. 3 and 4, in the locked position, the locking assembly 160 is engaged with the main body 110. For example, in some embodiments, the main body 110 defines one or more retention features 112. For example, in the embodiment depicted in FIGS. 3 and 4, the one or more retention features 112 are apertures extending through the main body 110, however, it should be understood that this is merely an example.

In the locked position, at least a portion of the locking assembly 160 engages the one or more retention features 112 of the main body 110. For example, in the embodiment depicted in FIGS. 3 and 4, the locking assembly 160 includes one or more locking members 162 engaged with the one or more retention features 112 of the main body 110 in the locked position. In particular, in the embodiment depicted in FIGS. 3 and 4, the one or more locking members 162 extend at least partially through the apertures defining the one or more retention features 112 of the main body 110 in the locked position. Engagement between the one or more locking members 162 of the locking assembly 160 with the one or more retention features 112 of the main body 110 restricts movement of the locking assembly 160 with respect to the main body 110 in the axial direction A. Because the locking assembly 160 is integral with or coupled to the ramp body 130, restriction of movement of the locking assembly 160 with respect to the main body 110 restricts movement of the ramp body 130 with respect to the main body 110 in the axial direction A. By restricting movement of the ramp body 130 with respect to the main body 110 in the axial direction A, the locking assembly 160 may retain the ramp body 130 in the extended position shown in FIG. 4 as force is applied to the ramp body 130 in the axial direction A, for example by the drill string 40 (FIG. 2A).

In some embodiments, the one or more locking members 162 are biased into engagement with the one or more retention features 112 of the main body 110. For example, in some embodiments, the one or more locking members 162 are outwardly-biased in the radial direction R.

In the embodiment depicted in FIGS. 3 and 4, the main body 110 defines a channel 116 extending through the main body 110 in the axial direction A. For example, the main body 110 may have a generally annular shape. The ramp body 130, in embodiments, is positioned at least partially within the channel 116, and is movable with respect to the main body 110 through the channel 116.

The one or more locking members 162, in some embodiments, define a channel engagement surface 164 that face outwardly in the radial direction R and face at least partially in the axial direction A. As the ramp body 130 moves in the axial direction A with respect to the main body 110, the channel engagement surface 164 of the one or more locking members 162 may engage a sidewall 118 of the channel 116. Engagement between the channel engagement surfaces 164 of the one or more locking members 162 and the sidewall 118 of the channel 116 may cause the one or more locking members 162 to deform inwardly in the radial direction R. In particular, engagement between the channel engagement surfaces 164 of the one or more locking members 162 and the channel 116 of the main body 110 may overcome the outward bias of the one or more locking members 162, such that the ramp body 130 can be moved from the retracted position (FIG. 3) to the extended position (FIG. 4). With the ramp body 130 in the extended position, the outwardly bias of the one or more locking members 162 bias the one or more locking members 162 into engagement with the one or more retention features 112 of the main body 110. While the locking assembly 160 is described as being coupled to or integral with the ramp body 130 and the main body 110 is described as including the one or more retention features 112, it should be understood that this is merely an example. For example, in embodiments described herein, the main body 110 may be coupled to the locking assembly 160, and the ramp body 130 may include the one or more retention features 112.

Referring to FIGS. 2A, 2E, 3, 4, and 5, a flowchart of an example method for using the whipstock assembly 100 is depicted. In a first block 502, the string engagement feature 170 of the whipstock assembly 100 is engaged. For example, the string engagement feature 170 may be engaged with the retrieval tool 62 attached to the string 60. In a second block 504, the ramp body 130 is rotated with respect to the main body 110 of the whipstock assembly 100. For example, the string 60 may rotate, and through engagement with the string engagement feature 170, the string 60 causes the ramp body 130 to rotate with respect to the main body 110 of the whipstock assembly 100. As described above, in embodiments, the ramp body 130 may rotate with respect to the main body 110 in the circumferential direction C about the pivot assembly 140.

At block 506, the ramp body 130 is moved from the retracted position (FIG. 3) to the extended position (FIG. 4). By rotating the ramp body 130 with respect to the main body 110 in the circumferential direction C and/or moving the ramp body 130 from the retracted position (FIG. 3) to the extended position (FIG. 4), the ramp body 130 can be moved within the main wellbore 10 (FIG. 1) without disengaging the packer assembly 150. By moving the ramp body 130 within the main wellbore 10 (FIG. 1) without disengaging the packer assembly 150, the ramp surface 132 may be oriented within the main wellbore 10 (FIG. 1) to direct the drill string 40 to drill the side wellbores 12, 12', 12", 12'" (FIG. 1) without disengaging the packer assembly 150. In this way, the whipstock assembly 100 may be utilized to form the side wellbores 12, 12', 12", 12'" (FIG. 1) while the main body 110 of the whipstock assembly 100 remains in place within the main wellbore 10 (FIG. 1). Because the main body 110 of the whipstock assembly 100 may remain in place within the main wellbore 10 (FIG. 1), whipstock assemblies 100 according to the present disclosure may be used to form multiple side wellbores without requiring retrieval of the whipstock assembly 100 to the surface 30 (FIG. 1). Because whipstock assemblies 100 can be used to form multiple side wellbores without disengaging the packer assembly 150 and/or retrieving the whipstock assembly 100, the time required to form multiple side wellbores in communication with the main wellbore 10 (FIG. 1) can be reduced as compared to conventional whipstock assemblies.

Accordingly, it should now be understood that embodiments according to the present disclosure are generally directed to whipstock assemblies including a ramp body that is movable with respect to a main body. For example, in some embodiments, a packer assembly is engaged with the main body, such that the main body is generally stationary with respect to the packer assembly and the wellbore. The ramp body, in embodiments, is rotatable and/or movable in an axial direction with respect to the main body of the whipstock assembly. By moving the ramp body with respect to the main body of the whipstock assembly (e.g., via rotation and/or movement in the axial direction), multiple side wellbores may be formed without disengaging the packer assembly, thereby reducing the time and cost associated with forming the side wellbores.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus it is intended that the specification cover the modifications and variations of the various described embodiments provided such modifications and variations come within the scope of the appended claims and their equivalents.

It is noted that recitations herein of a component of the present disclosure being "structurally configured" in a particular way, to embody a particular property, or to function in a particular manner, are structural recitations, as opposed to recitations of intended use. More specifically, the references herein to the manner in which a component is "structurally configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A whipstock assembly comprising:

a main body defining an axial direction extending through the main body, a circumferential direction, and a radial direction transverse to the axial direction;

a ramp body pivotally coupled to the main body, the ramp body defining a ramp surface that is oriented transverse to the radial direction, wherein:

the ramp body is movable between a retracted position and an extended position, wherein the ramp surface is further from the main body in the axial direction in the extended position as compared to the retracted position; and the ramp body is rotatable with respect to the main body about the circumferential direction; and a locking assembly, the locking assembly positionable between a locked position, in which the locking assembly restricts movement of the ramp body with respect to the main body in the axial direction, and an unlocked position, in which the ramp body is movable with respect to the main body in the axial direction.

2. The whipstock assembly of claim 1, further comprising a packer assembly engaged with and extending outward from the main body, wherein the packer assembly is positionable between an engaged position, in which the packer assembly defines an engaged packer perimeter, and a disengaged position, in which the packer assembly defines a disengaged packer perimeter that is less than the engaged packer perimeter.

3. The whipstock assembly of claim 1, wherein the locking assembly is spaced apart from the main body in the axial direction in the unlocked position.

4. The whipstock assembly of claim 1, wherein the main body defines one or more retention features, and wherein the locking assembly comprises one or more locking members that engage the one or more retention features in the locked position.

5. The whipstock assembly of claim 4, wherein the one or more locking members of the locking assemblies are biased radially outward such that they engage the one or more retention features of the main body when the ramp body is moved into the extended position.

6. The whipstock assembly of claim 1, further comprising a string engagement feature coupled to the ramp body, wherein the string engagement feature is structurally configured to engage a string that moves the ramp body from the retracted position to the extended position.

7. The whipstock assembly of claim 1, further comprising a pivot assembly positioned between the ramp body and the main body, wherein the ramp body is rotatable with respect to the main body about the pivot assembly.

8. The whipstock assembly of claim 7, wherein the pivot assembly comprises:

a main body portion coupled to the main body and comprising one or more main body teeth; and a ramp body portion coupled to the ramp body and comprising one or more ramp body teeth engageable with the one or more main body teeth.

9. The whipstock assembly of claim 1, further comprising:

a packer assembly engaged with and extending outward from the main body, wherein the packer assembly is positionable between an engaged position, in which the packer assembly defines an engaged packer perimeter, and a disengaged position, in which the packer assembly defines a disengaged packer perimeter that is less than the engaged packer perimeter; and a pivot assembly positioned between the ramp body and the main body, wherein the ramp body is rotatable with respect to the main body about the pivot assembly; and wherein:

the locking assembly is spaced apart from the main body in the axial direction in the unlocked position;

the main body defines one or more retention features, and the locking assembly comprises one or more locking members that engage the one or more retention features in the locked position; and the locking assembly is coupled to or integral with the ramp body.

10. The whipstock assembly of claim 1, wherein the locking assembly is coupled to or integral with the ramp body.

11. A method for drilling a wellbore, the method comprising:

engaging a string engagement feature of a whipstock assembly with a string;

rotating a ramp body of the whipstock assembly with the string in a circumferential direction with respect to a main body of the whipstock assembly, wherein the ramp body is pivotally coupled to the main body of the whipstock assembly;

moving the ramp body from a retracted position to an extended position, wherein a ramp surface of the ramp body is further from the main body in an axial direction in the extended position as compared to the retracted position; and engaging a locking assembly with the main body to thereby restrict movement of the ramp body with respect to the main body in the axial direction.

12. The method of claim 11, further comprising engaging the ramp surface with a drill string, thereby directing the drill string in a direction that is transverse to the axial direction.

13. The method of claim 11, further comprising engaging the main body and a sidewall of the wellbore with a packer assembly.

14. The method of claim 11, wherein moving the ramp body from the retracted position to the extended position comprises moving the ramp body with respect to the main body with the string.

15. The method of claim 11, wherein engaging the locking assembly with the ramp body comprises moving one or more locking members of the locking assembly into engagement with one or more retention features of the main body.

16. The method of claim 11, further comprising, subsequent to rotating the ramp body, engaging one or more main body teeth of a pivot assembly with one or more ramp body teeth of the pivot assembly.

17. A whipstock assembly comprising:

a main body defining an axial direction extending through the main body and a circumferential direction;

a ramp body pivotally coupled to the main body, the ramp body defining a ramp surface that is oriented transverse to the axial direction;

a locking assembly, the locking assembly positionable between a locked position, in which the locking assembly restricts movement of the ramp body with respect to the main body in the axial direction, and an unlocked position, in which the ramp body is movable with respect to the main body in the axial direction; and a pivot assembly positioned between the ramp body and the main body, wherein the ramp body is rotatable with respect to the main body about the pivot assembly in the circumferential direction.

18. The whipstock assembly of claim 17, wherein the pivot assembly comprises:

a main body portion coupled to the main body and comprising one or more main body teeth; and a ramp body portion coupled to the ramp body and comprising one or more ramp body teeth engageable with the one or more main body teeth.

19. The whipstock assembly of claim 17, further comprising a string engagement feature coupled to the ramp body, wherein the string engagement feature is structurally configured to engage a string that moves the ramp body from a retracted position to an extended position.

20. The whipstock assembly of claim 17, further comprising a packer assembly engaged with and extending outward from the main body, wherein the packer assembly is positionable between an engaged position, in which the packer assembly defines an engaged packer perimeter, and a disengaged position, in which the packer assembly defines a disengaged packer perimeter that is less than the engaged packer perimeter.

* * * * *